US007390955B2

(12) United States Patent
Parsons et al.

(10) Patent No.: US 7,390,955 B2
(45) Date of Patent: Jun. 24, 2008

(54) METRONOME WITH WIRELESS TRANSDUCER

(75) Inventors: Christopher V. Parsons, San Antonio, TX (US); David M. Tumey, Crestview, FL (US)

(73) Assignee: Solutions for Thought, LLC, San Antonio, TX (US)

( * ) Notice: Subject to any disclaimer, the term of this patent is extended or adjusted under 35 U.S.C. 154(b) by 250 days.

(21) Appl. No.: 11/138,754

(22) Filed: May 26, 2005

(65) Prior Publication Data

US 2006/0070513 A1 Apr. 6, 2006

Related U.S. Application Data

(63) Continuation-in-part of application No. PCT/US03/23633, filed on Jul. 29, 2003, which is a continuation of application No. 10/306,263, filed on Nov. 27, 2002, now abandoned.

(51) Int. Cl.
*G10H 1/40* (2006.01)
*G10H 7/00* (2006.01)

(52) U.S. Cl. ..... 84/611; 84/600; 84/612; 84/651; 84/652; 84/723

(58) Field of Classification Search ..... None
See application file for complete search history.

(56) References Cited

U.S. PATENT DOCUMENTS 1,425,523 A 8/1922 Hammond, Jr.
3,467,959 A 9/1969 Zazofsky
3,595,122 A 7/1971 Brediceanu
3,919,915 A * 11/1975 Isbell ..... 84/484
3,991,648 A 11/1976 Karpowicz
D249,936 S 10/1978 Ishida
4,193,257 A * 3/1980 Watkins ..... 84/484
4,462,297 A 7/1984 Dill et al.
4,559,929 A 12/1985 Hseu
4,570,616 A 2/1986 Kunz et al.
4,602,551 A * 7/1986 Firmani et al. ..... 84/484
4,853,854 A * 8/1989 Behar et al. ..... 700/295
5,054,361 A 10/1991 Usa
5,515,764 A 5/1996 Rosen (Continued)

FOREIGN PATENT DOCUMENTS

EP 1 523 163 4/2005

(Continued)

OTHER PUBLICATIONS

A DVD video (d. Jul. 29, 2003) of Parsons' classroom test of prototype w/ mixed student population, incl. partially deaf and borderline autistic children.

*Primary Examiner*—Marlon Fletcher
(74) *Attorney, Agent, or Firm*—Gunn & Lee, P.C.

(57) ABSTRACT

A metronome for use by a musician or group of musicians generally includes a signal generator for producing an electrical signal according to a desired timing scheme and one or more transducers in wireless communication with the signal generator. Each transducer, which may take the form of a piezoelectric device, a buzzer, electrodes or any substantial equivalent, is adapted to impart a sensation to the musician in response to the generated electrical signal. The wireless communication may be established with an infrared link or a radio frequency transmission system. The signal generator is under the centralized control of a conductor, bandleader, lead musician or music instructor.

16 Claims, 6 Drawing Sheets

U.S. PATENT DOCUMENTS

| | | | | |
|---|---|---|---|---|
| 5,581,484 | A | 12/1996 | Prince | |
| 5,959,230 | A | 9/1999 | Fulford | |
| 6,040,517 | A | 3/2000 | Sakamoto | |
| 6,090,037 | A * | 7/2000 | Gavish | 600/27 |
| 6,102,875 | A | 8/2000 | Jones | |
| 6,217,533 | B1 | 4/2001 | McCambridge | |
| 6,432,072 | B1 | 8/2002 | Harris et al. | |
| 6,461,377 | B1 | 10/2002 | An | |
| 6,653,545 | B2 | 11/2003 | Redmann et al. | |
| 6,714,123 | B1 | 3/2004 | Miyake et al. | |
| D488,078 | S | 4/2004 | Nakajima et al. | |
| 6,737,572 | B1 | 5/2004 | Jameson et al. | |
| 6,774,297 | B1 | 8/2004 | Lee | |
| 6,850,150 | B1 | 2/2005 | Ronkainen | |
| 6,850,782 | B2 | 2/2005 | Bright et al. | |
| 2002/0149561 | A1 | 10/2002 | Fukumoto et al. | |
| 2002/0165921 | A1 | 11/2002 | Sapieyevski | |
| 2003/0003976 | A1 | 1/2003 | Mura | |
| 2003/0024375 | A1 | 2/2003 | Sitrick | |
| 2003/0236101 | A1 | 12/2003 | Kemppinen | |
| 2004/0067780 | A1 | 4/2004 | Eiden | |
| 2004/0079220 | A1 | 4/2004 | Yagi | |
| 2004/0099132 | A1 | 5/2004 | Parsons | |
| 2004/0100366 | A1 | 5/2004 | Parsons | |
| 2004/0168565 | A1 | 9/2004 | Nagao et al. | |
| 2004/0255756 | A1 | 12/2004 | Nagakura | |
| 2005/0064912 | A1 | 3/2005 | Yang et al. | |
| 2005/0275508 | A1 | 12/2005 | Orr et al. | |
| 2006/0070514 | A1 * | 4/2006 | Parsons et al. | 84/730 |

FOREIGN PATENT DOCUMENTS

| | | |
|---|---|---|
| EP | 1 600 907 | 11/2005 |
| JP | 58113779 | 7/1983 |
| JP | 10 248192 | 9/1998 |
| JP | 2001154672 | 6/2001 |
| JP | 2001 259134 | 9/2001 |
| JP | 2002261637 | 9/2002 |
| JP | 2003 145049 | 5/2003 |
| JP | 2004 113944 | 4/2004 |
| JP | 2004205483 | 7/2004 |
| JP | 2004317404 | 11/2004 |
| WO | WO 03/052528 | 6/2003 |
| WO | WO 03/062930 | 7/2003 |
| WO | WO 03/105313 | 12/2003 |

* cited by examiner

METRONOME WITH WIRELESS TRANSDUCER

RELATED APPLICATIONS

This application claims priority, under 35 U.S.C. § 120 as a continuation-in-part, to P.C.T. international application Serial No. PCT/US03/23633 filed Jul. 29, 2003 and designating the United States, which is a continuation of U.S. patent application Ser. No. 10/306,263 filed Nov. 27, 2002 now abandoned. By this reference the full disclosures, including the drawings, of P.C.T international application Serial No. PCT/US03/23633 and U.S. patent application Ser. No. 10/306,263 are incorporated herein as though now set forth in their respective entireties. Additionally, the full disclosures, including the drawings, of Applicant's co-pending U.S. patent application entitled VIBRATING TRANSDUCER WITH PROVISION FOR EASILY DIFFERNTIATED MULTIPLE TACTILE STIMULATIONS filed May 26, 2005 in the name of David M. Tumey and Applicant's co-pending U.S. patent application entitled TACTILE METRONOME filed May 26, 2005 in the names of Christopher V. Parsons and David M. Tumey are incorporated herein as though each were now set forth in their respective entireties.

FIELD OF THE INVENTION

The present invention relates to music technology. More particularly, the invention relates to a metronome with provision for communication with a musician through a transducer located remotely from a signal generator, communication between the signal generator and remotely located transducer being through a wireless communication channel.

BACKGROUND OF THE INVENTION

The metronome is well established as a fundamental tool of musical education. Having been developed before the advent of the electrical apparatus, the traditional metronome comprises a mechanical assembly adapted to generate a clicking sound at a desired beat frequency. With the advent of modern electronics a very precise audio output may now be produced or, as is particularly useful for the musical education of deaf persons, the output signal from the metronome may be communicated with a visual indicator such as a flashing light.

While the improvements made possible through technology are meritorious, Applicant has discovered that the improvements generally serve only to better implement a fundamentally flawed method. In particular, Applicant has noted that the audio nature of the metronome, which is apparently a holdover from the days of primitive technology, is distracting to the musician and, in at least some musical environments, ineffective due to the inability of the musician to clearly hear the audio signal. Additionally, the audio signal is wholly inappropriate for use by the hearing impaired. While this latter issue has been at least addressed through metronomes with visual outputs, it is noted that the use of the visual indicator mandates that the musician completely memorizes his or her music. Additionally, traditional metronomes are self-contained. As a result, it is cumbersome for a conductor, bandleader or lead musician to control the output of a metronome being used by another. Further, such traditional metronomes can be used only by multiple musicians in close proximity one to another. Still further, the use of multiple traditional metronomes by multiple musicians is made virtually impossible by the inability to synchronize the timing of the outputs of the multiple metronomes.

It is therefore an overriding object of the present invention to improve over the prior art by providing a metronome that is free of the foregoing flaws. In particular, it is an object of the present invention to provide a metronome having a wireless interconnection between a central signal generator and one or more remotely located transducers. Additionally, it is an object of the present invention to provide such a metronome that also may be programmed to provide enhanced capabilities such as, for example, complex output rhythms and/or tactile stimulation designed for the development of articulation. Finally, it is an object of the present invention to provide such a metronome that is also economical to produce and easy to use.

SUMMARY OF THE INVENTION

In accordance with the foregoing objects, the present invention—a metronome for use under the control of a leader by one or more musicians, generally comprises a base unit, for generating and transmitting timing signals, and a transducer unit, for producing, according to the signals generated by the base unit, stimulations perceivable by a musician located at a place remote from the base unit. The metronome may be implemented with a single transducer unit or multiple transducer units. An unlimited number of transducer units may be implemented so long as each receiver of the transducer units is tuned to receive the signals output from the transmitter of the base unit.

The base unit of the metronome of the present invention preferably generally comprises a signal generator in electrical communication with a controller and a transmitter. The controller is preferably programmed to facilitate user selection of the characteristics of the signal generated by the signal generator and for controlling the transmission through the transmitter of generated signals. A display, which may comprise a liquid crystal display, light emitting diode display or any other substantially equivalent structure, and a user input system, which may comprise a touch screen control and/or a computer interface such as a USB port, wireless interface or the like, or buttons or dials, are also preferably provided in connection with the controller for use in inputting and monitoring user selections.

The transducer unit (or units) of the metronome preferably generally comprises a receiver, for receiving the signal transmitted from the transmitter of the base unit, and a transducer, for producing according to the received signal a stimulation perceivable by the musician using the transducer unit. Additionally, the transducer unit may comprise a driver circuit as may be necessary to convert the output from the receiver to a signal appropriate for use by the transducer.

Although any wireless technology, such as, for example, an infrared transmission system, may be utilized for implementation of the present invention, it is preferable to utilize a radio frequency transmission system as a radio frequency transmission system generally has greater range capability than does an infrared system and is also generally more impervious to varying lighting conditions and the presence of obstructions between the base unit and a remotely located transducer unit. Additionally, an appropriate radio frequency transmission system may generally be as readily and economically implemented as any other wireless technology.

In at least one embodiment, the signal generator is adapted to produce complex rhythms and may be programmable such that the musician may define the complex rhythm. In this embodiment, the signal generator preferably further comprises a micro-controller.

In at least one embodiment of the present invention, a vibrating transducer for producing multiple, readily differentiable tactile stimulations is provided. In the preferred embodiment of the present invention, the vibrating transducer generally comprises a rigid housing; an electric motor enclosed within the rigid housing and having attached thereto an eccentric weight; and wherein the electric motor is supported within the rigid housing by a flexible motor mount. The rigid housing comprises a generally cylindrically shaped tube.

The flexible motor mount may be formed of a cushion, which may be made from foam material or the like. In at least one embodiment of the present invention, the cushion is wrapped substantially about the electric motor, centering the electric motor within the cylindrically shaped tube forming the rigid housing. In order to facilitate manufacture of the vibrating transducer of the present invention, the cushion may be wrapped by a securing sheet such as, for example, a thin paper wrapping, a length of adhesive tape or the like.

In a further embodiment of the vibrating transducer of the present invention, a driver circuit may be provided for facilitating operation of the electric motor. The driver circuit may include a current amplifier.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 1:
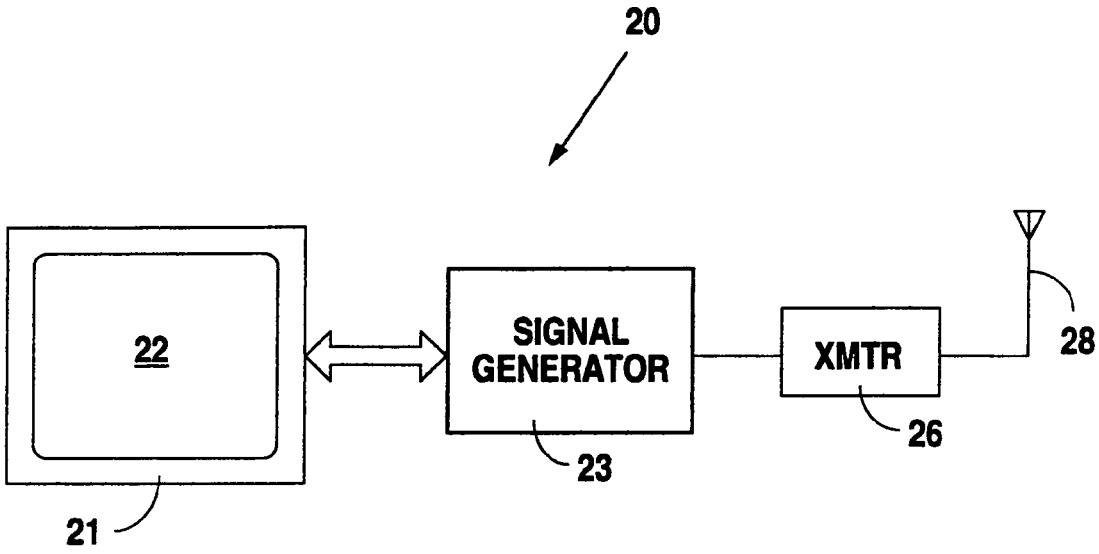
FIG. 1 shows, in a functional block diagram, the preferred embodiment of the base unit of the metronome of the present invention.
Figure 2:
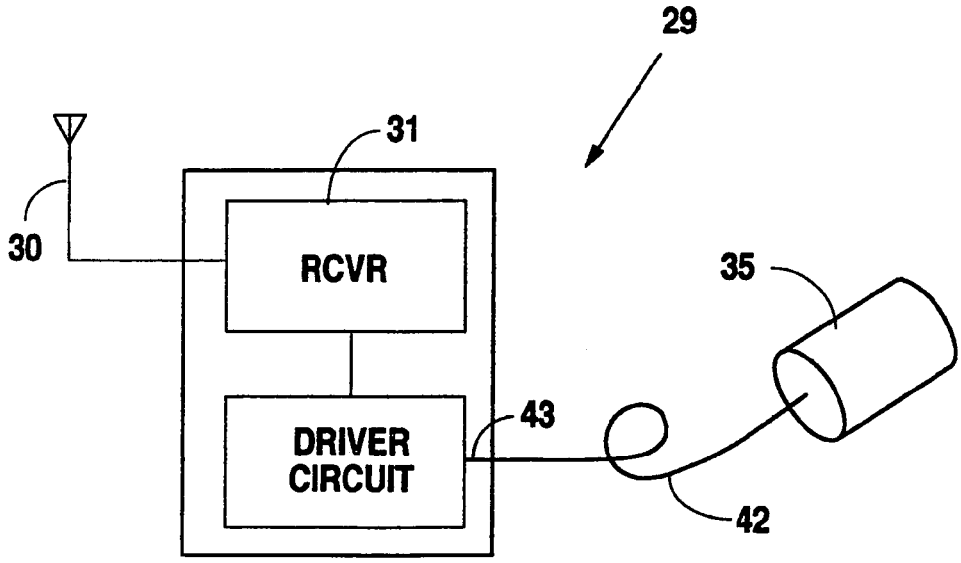
FIG. 2 shows, in a functional block diagram, the preferred embodiment of the transducer unit of the metronome of the present invention.

Referring now to FIGS. 1 and 2, in particular, the metronome of the present invention is shown to generally comprise a base unit 20, for generating and transmitting timing signals, and a transducer unit 29, for producing, according to the signals generated by the base unit 20, stimulations perceivable by a musician located at a place remote from the base unit 20. Although the present invention may be implemented with a single transducer unit 29, it is noted that the present invention also contemplates implementations comprising multiple transducer units 29. As will be appreciated by those of ordinary skill in the art, and as will be clearer further herein, an unlimited number of transducer units 29 may be implemented so long as each receiver 31 of the transducer units 29 is tuned to receive the signals output from the transmitter 26 of the base unit 20.

Referring now to FIG. 1, the base unit 20 of the metronome of the present invention is shown to generally comprise a signal generator 23 in electrical communication with a controller 21 and a transmitter 26. The controller 21 is preferably programmed to facilitate user selection of the characteristics of the signal generated by the signal generator 23 and for controlling the transmission through the transmitter 26 of generated signals. A display, which may comprise a liquid crystal display, light emitting diode display or any other substantially equivalent structure, and a user input system, which may comprise a touch screen control 22, as shown in FIG. 1, and/or a computer interface such as a USB port, wireless interface or the like, or buttons or dials, are also preferably provided in connection with the controller 21 for use in inputting and monitoring user selections.

As shown in FIG. 2, the transducer unit 29 (or units) of the present invention generally comprises a receiver 31, for receiving the signal transmitted from the transmitter 26 of the base unit 20, and a transducer 35, for producing according to the received signal a stimulation perceivable by the musician using the transducer unit 29. Additionally, the transducer unit 29 may comprise a driver circuit 53 as may be necessary to convert the output from the receiver 31 to a signal appropriate for use by the transducer 35.

Although those of ordinary skill in the art will recognize that any wireless technology, such as, for example, an infrared transmission system, may be utilized for implementation of the present invention, Applicant has found it preferable to utilize a radio frequency transmission system. As will be appreciated by those of ordinary skill in the art, a radio frequency transmission system generally has greater range capability than does an infrared system and is also generally more impervious to varying lighting conditions and the presence of obstructions between the base unit 20 and a remotely located transducer unit 29. Additionally, an appropriate radio frequency transmission system may generally be as readily and economically implemented as any other wireless technology.

Figure 3:
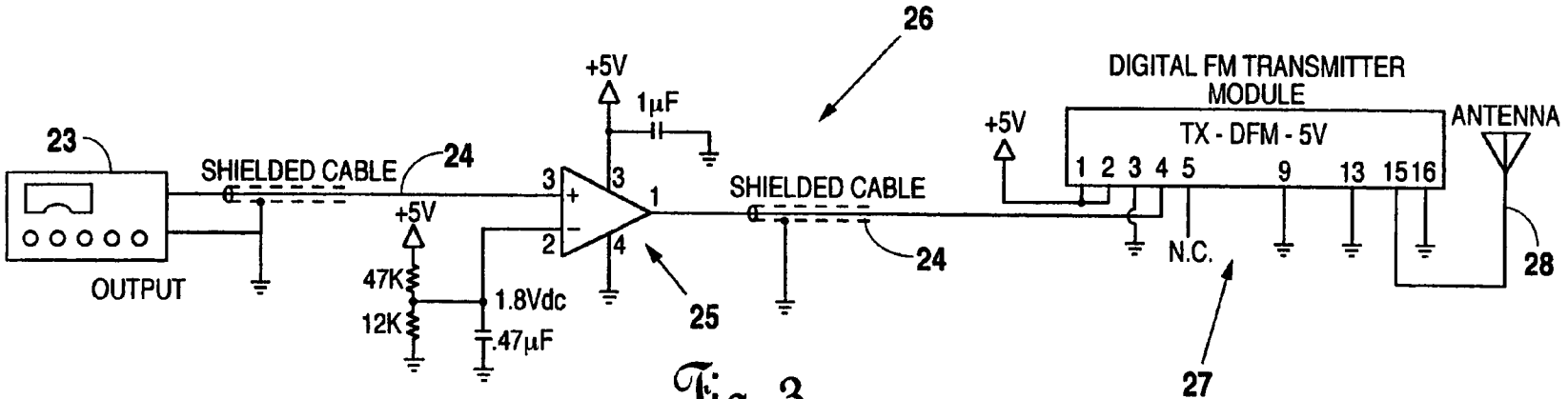
FIG. 3 shows, in a schematic diagram, details of one embodiment of a transmitter circuit, as depicted in FIG. 1, appropriate for implementation of the base unit of the metronome of the present invention.
Figure 5:
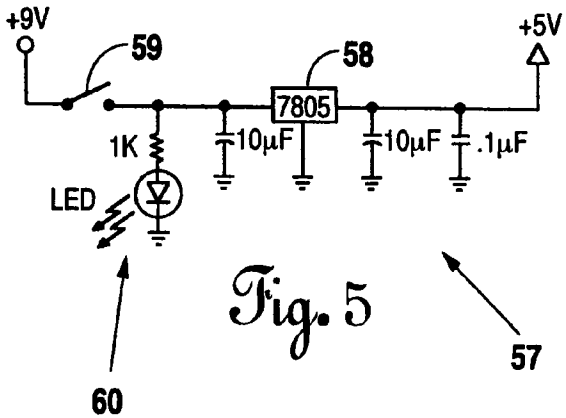
FIG. 5 shows, in a schematic diagram, details of one embodiment of a power conditioning circuit as may be implemented for use with the transmitter circuit of FIG. 3 and/or the receiver circuit of FIG. 4.
Figure 4:
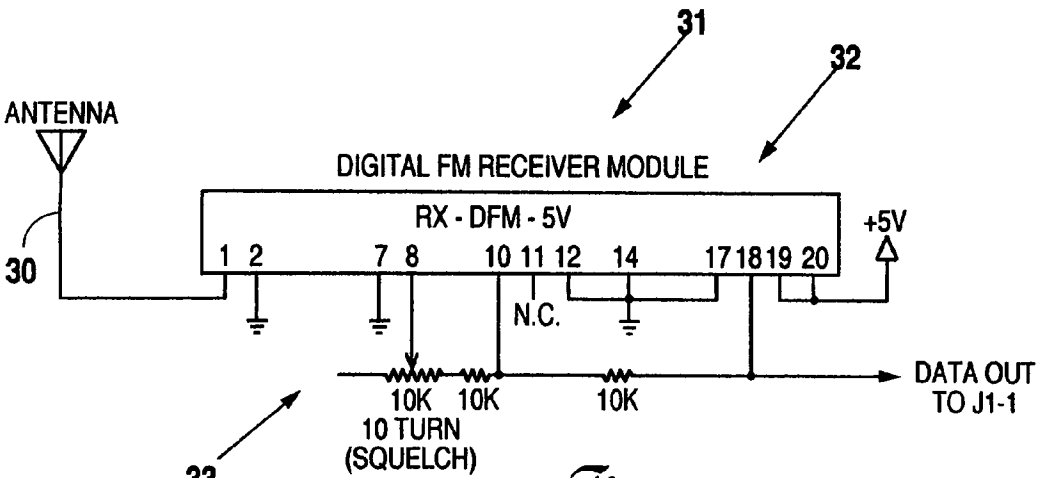
FIG. 4 shows, in a schematic diagram, details of one implementation of a receiver circuit, as depicted in FIG. 2, appropriate for implementation of the transducer unit of the metronome of the present invention.

Referring now to FIGS. 3 through 5, in particular, an exemplary radio frequency transmission system, as may be utilized in implementation of the present invention, is shown to generally comprise a radio frequency transmitter 26 (depicted in FIG. 3) and a radio frequency receiver 31 (depicted in FIG. 4). As will be understood by those of ordinary skill in the art, the receiver 31 is tuned to receive the signal output from the transmitter 26. Additionally, as shown in FIG. 5, the radio frequency transmission system may also comprise power conditioning and regulation circuitry 57 as may be necessary for operation of both the transmitter 26 and the receiver 31.

Referring now to FIG. 3, it is shown that an appropriate transmitter 26 may be implemented utilizing a commercially available, off-the-shelf digital transmitter module 27. One such module 27 is the model TX-DFM-5V digital frequency modulated ("FM") transmitter module available from AUREL S.p.A. of Modigliana, Italy. In implementing the base unit 20 with such a transmitter 26, the signal output from the signal generator 23 is fed, preferably through a shielded cable 24 to prevent interference, into the manufacturer-designated input pin of the integrated transmitter module 27. The integrated transmitter module then modulates the input signal onto a carrier radio frequency, as is well understood to those of ordinary skill in the art. The modulated carrier radio frequency is then fed from the manufacturer-designated output pin of the integrated transmitter module 27 to an antenna 28 for transmission to the remotely located transducer unit 29. Additionally, as shown in FIG. 3, a buffer 25 may be provided in the channel between the signal generator 23 and the transmitter 26 to ensure that the signal output from the signal generator 23 is electrically compatible with the integrated transmitter module 27.

Referring now to FIG. 4, it is shown that an appropriate receiver 31 may be implemented utilizing a commercially available, off-the-shelf digital receiver module 32 compatible with the transmitter module 27. One such module 32 is the model RX-DFM-5V digital FM receiver module also available from AUREL S.p.A. of Modigliana, Italy. In implementing the transducer unit 29 with such a module 32, the signal transmitted from the base unit 20 is received through an antenna 30 into the manufacturer-designated input pin of the integrated receiver module 32. As is well understood by those of ordinary skill in the art, the integrated receiver module 32 demodulates the signal placed on the carrier signal from the carrier signal and outputs the resulting signal, which is essentially the signal output from the signal generator 23 of the base unit 20, through the manufacturer-designated output pin from the integrated receiver module 32. The output signal is then fed to the transducer 35 either directly or, if necessary, through a driver circuit 53, as will be discussed in more detail further herein. In any case, Applicant has also found it desirable to provide a squelch function 33 in association with the integrated receiver module 32 to prevent unintended operation of the transducer 35 such as may occur if the receiver 31 should pick up radio frequency interference or noise through its antenna 30. As will be appreciated by those of ordinary skill in the art, typical integrated receiver modules 32 are available off-the-shelf with this feature, implementation requiring only the provision of a multi-turn potentiometer 34 at the manufacturer-designated pins of the integrated receiver module 32.

As shown in FIG. 5, and previously discussed, both the transmitter 26 and the receiver 31 may be provided with power conditioning and regulation circuitry 57. As shown in the figure, such circuitry 57 may include an integrated voltage regulator 58 for maintaining a constant voltage for powering of the transmitter 26 and/or receiver 31. Additionally, one or more capacitors to ground may be provided to filter out high frequency noise as may be expected in the implementation of any radio frequency transmission system. Still further, however, such a circuit 57 preferably comprises an ON-OFF switch 59 and may also include a power on indicator 60, which may be readily implemented with a light emitting diode ("LED") connected to the unregulated power bus through a current limiting resistor.

As previously discussed, the transducer unit 29 of the metronome of the present invention may comprise a driver circuit 53 for interfacing with the transducer 35. Importantly, it is noted that implementations utilizing a transducer 35 comprising an electric motor will typically require a driver circuit, such as the driver circuit 53 shown in FIG. 6, comprising an output amplifier 54, which enables logical level signals, such as output from the above-described receiver 31, to drive an electric motor (such as is utilized in the preferred implementation of a vibrating transducer 36 described in detail further herein). As will be appreciated by those of ordinary skill in the art, this requirement stems from the fact that such an electric motor will generally have a current requirement beyond the capabilities of most solid state components. Additionally, in such implementations, the driver circuit 53 will also require implementation of a power conditioning circuit 56 having the capability to prevent and/or suppress voltage spiking, such as may be expected in response to the highly inductive load typical of the type of electric motor utilized in the implementation of the vibrating transducer 36.

Figure 6:
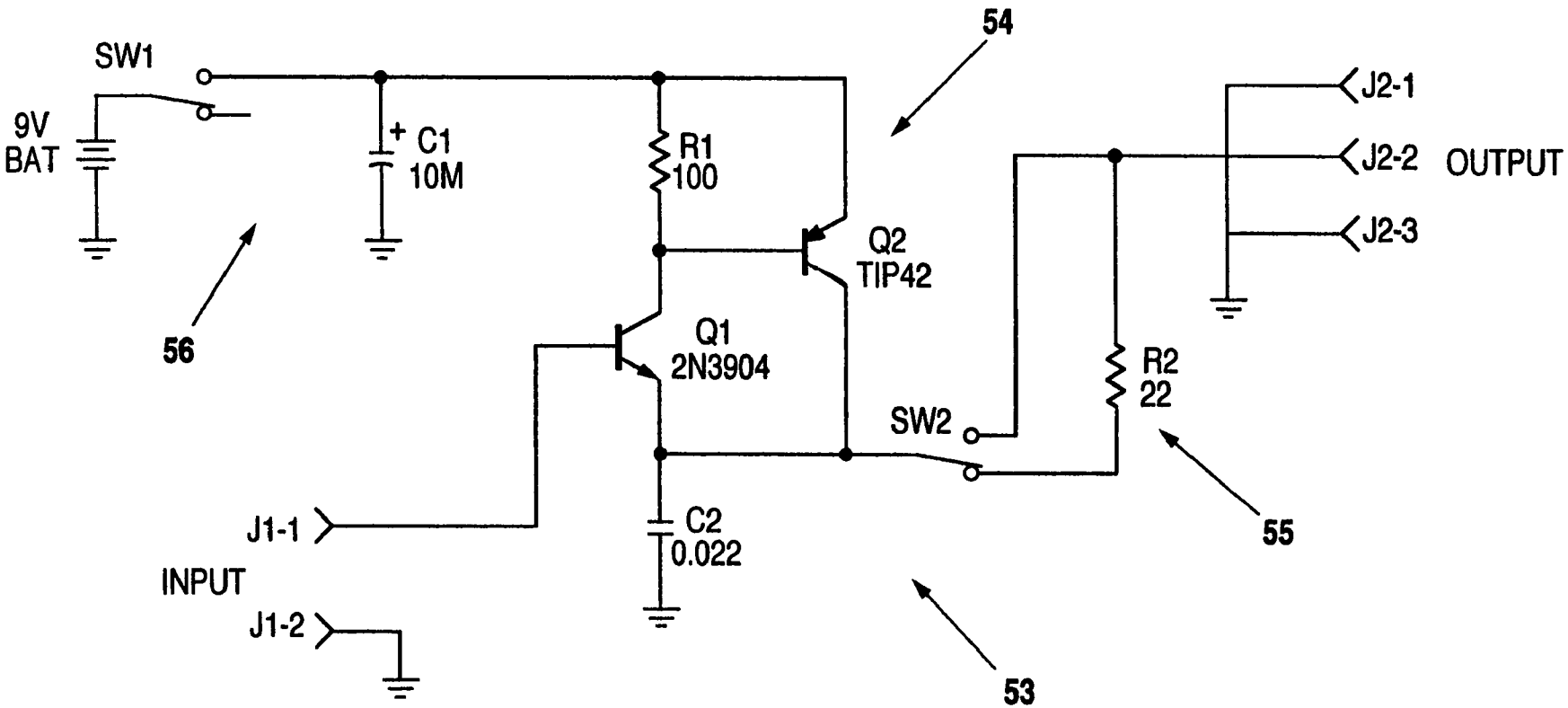
FIG. 6 shows, in a schematic diagram, details of one embodiment of a driver circuit, as depicted in FIG. 2, appropriate for operation of the vibrating transducer of FIG. 7.

As shown in FIG. 6, an exemplary output amplifier 54, as is appropriate for use with the vibrating transducer 36 described further herein, comprises a 2N3904 NPN BJT transistor Q1, configured as an emitter follower, coupled with a TIP42 high current PNP transistor Q2 in a TO-220 heat dissipating package, for providing the necessary current for operation of the electric motor 40 of the vibrating transducer 36. As will be recognized by those of ordinary skill in the art, the output amplifier 54 as shown may be considered a two stage, high current emitter follower. The power conditioning circuit 56, which is preferably provided to prevent and/or suppress voltage spiking, such as may be expected in response to the highly inductive load typical of the type of electric motor 40 utilized in the implementation of the vibrating transducer 36 may be implemented by tying a 10 μF electrolytic capacitor C1 to ground from the 9-V power bus from, for example, a 9-V battery BAT. As will be recognized by those of ordinary skill in the art, the electrolytic capacitor Cl will temporarily supply additional current to the 9-V bus as may be required to compensate for transients resulting from the draw upon the output amplifier 54 caused during startup of the electric motor 40 of the vibrating transducer 36. Additionally, the power conditioning circuit 56 preferably comprises an ON-OFF switch SW1 and may also include a power on indicator, if desired.

In order to adjust the "feel" of the metronome, as implemented with a tactile vibrating transducer 36, the output from the output amplifier 54 is preferably fed through an output power level selector 55 to an output jack J2, into which the power cord plug 43 of the power cord 42 to the electric motor 40 of the vibrating transducer 36 may be operably inserted. As shown in FIG. 6, the output power level selector 55 preferably comprises a 22 Ω resistor R2, which is selectively placed in series with the output circuit by selecting the appropriate position of a single pole, single throw switch SW2. Although Applicant has found that 22 Ω is an appropriate value for the resistor R2, it is noted that the value is selected empirically in order to obtain the user desired tactile feel for the "low" output selection. Additionally, those of ordinary skill in the art will recognize that the resistor R2 may be replaced with a potentiometer, thereby providing a fully adjustable output power level.

Although the driver circuit 53 has been described as being integral with the transducer unit 29, it should be appreciated that the present invention contemplates that any necessary driver circuit may be provided as part of the transducer 35. In this manner, the transducer unit 29 may be utilized with virtually any type of transducer 35, the driver circuit being adapted to provide all necessary electrical compatibility between the chosen transducer 35 and the output of the receiver 31. In such an implementation, the driver circuit should be provided with an input jack J1 for receiving signals from the receiver 31.

Referring now to the FIGS. 7 through 11 in particular, a preferred embodiment of a tactile transducer, as preferred for use in implementing the metronome of the present invention, is shown to comprise a vibrating transducer 36 having the unique ability to produce multiple easily differentiated tactile stimulations. As shown in the figures, such a vibrating transducer 36 generally comprises an electric motor 40 having attached thereto an eccentric weight 45 and encased within a rigid housing 37. As is typical with pager transducers and the like, operation of the electric motor 40 turns a shaft 46 upon which the eccentric weight 45 is mounted with, for example, a pin 47. As will be appreciated by those of ordinary skill in the art, rotation upon the shaft 46 of the eccentric weight 45 produces a vibratory effect upon the motor 40 resulting from the forward portion 44 of the motor 40 attempting to shift laterally outward from the nominal axis of rotation 48 of the shaft 46, as depicted by the centrifugal force lines F in FIG. 10.

In typical implementations of this principle, the electric motor is rigidly fixed to some body such as, for example, a pager or cellular telephone housing with mounting clamps, brackets or the like. In the present implementation, however, unlike the vibrating transducers of the prior art, the electric motor 40 is encased within a rigid housing 37 by the provision of a flexible motor mount 49, which allows the forward portion 44 of the electric motor 40 to generally wobble within the rigid housing 37 as the eccentric weight 45 is rotated upon the motor shaft 46. In this manner, the resultant forces F are the product of much greater momentum in the eccentric weight 45 than that obtained in the fixed configuration of the prior art.

Figure 7:
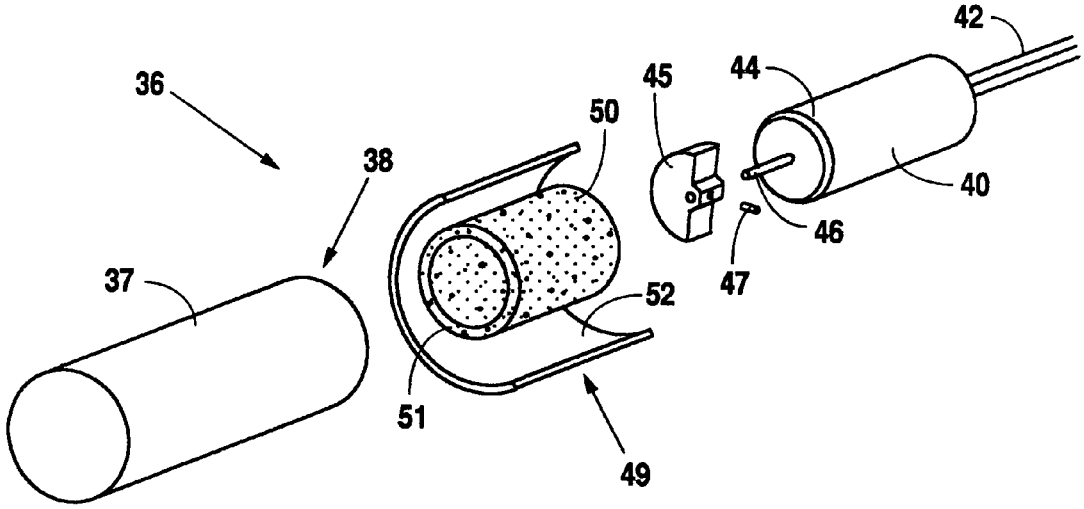
FIG. 7 shows, in an exploded perspective view, the preferred embodiment of a vibrating transducer as has been found to be optimum for use with the transducer unit of FIG. 2.
Figure 8:
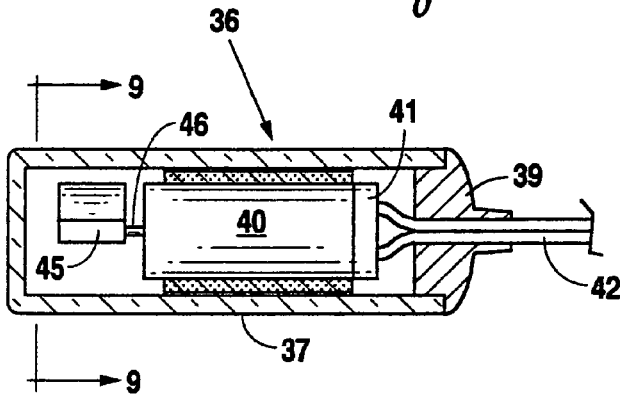
FIG. 8 shows, in a cross sectional side view, details of the arrangement of the internal components of the vibrating transducer of FIG. 7.

In the preferred implementation, as particularly detailed in FIGS. 7 through 10, the flexible motor mount 49 generally comprises a wrapping of preferably foam cushion material 50, which is sized and shaped to snuggly fill the space provided between the electric motor 40 and the interior of the rigid housing 37. To facilitate manufacture of the vibrating transducer 36, as generally depicted in FIG. 7, the foam cushion 50 may be held in place about the body of the electric motor 40 with a cushion securing sheet 52, which may comprise a thin paper glued in place about the cushion 50, thin adhesive tape or any substantially equivalent means. To complete the manufacture of the vibrating transducer 36, the cushioned electric motor 40, with eccentric weight 45 attached to its shaft 46, is inserted into the rigid housing 37 and secured in place by the application of epoxy 39 into the open, rear portion 38 of the housing 37. As will be understood by those of ordinary skill in the art, the epoxy 39 also serves to stabilize the power cord 42 to the rear portion 41 of the electric motor 40, thereby preventing accidental disengagement of the power cord 42 from the electric motor 40.

Figure 9:
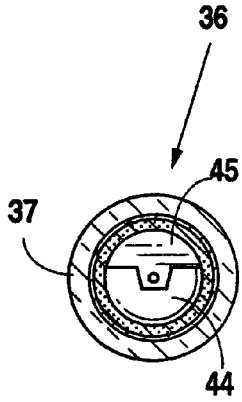
FIG. 9 shows, in a cross sectional end view taken through cut line 9-9 of FIG. 8, additional details of the arrangement of the internal components of the vibrating transducer of FIG. 7.
Figure 10:
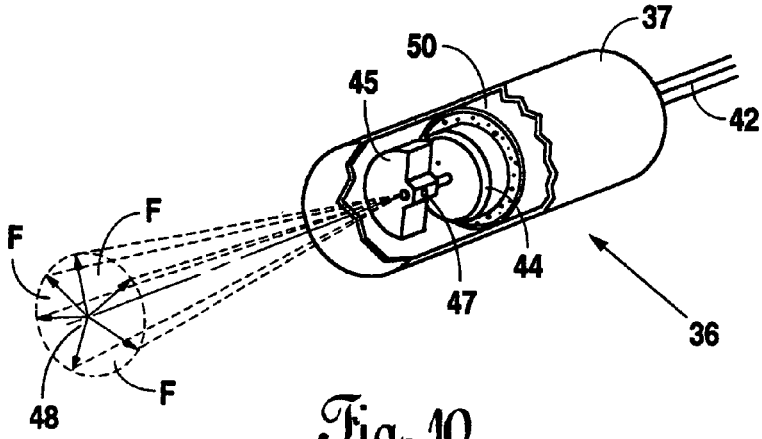
FIG. 10 shows, in a partially cut away perspective view, a representation of the forces produced in the operation of the vibrating transducer of FIG. 7.
Figure 11A:
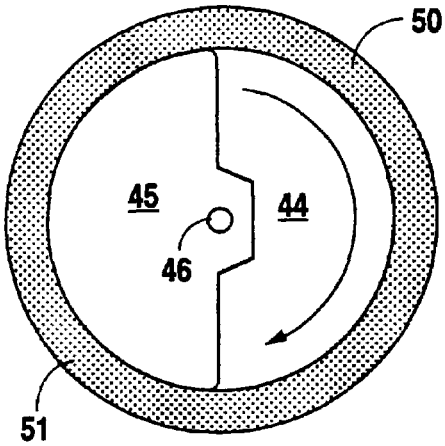
FIGS. 11A through 11F show, in schematic representations generally corresponding to the view of FIG. 9, changes in the relative positions of various internal components of the vibrating transducer of FIG. 7, which changes occur as a result of the operational forces represented in FIG. 10.
Figure 11B:
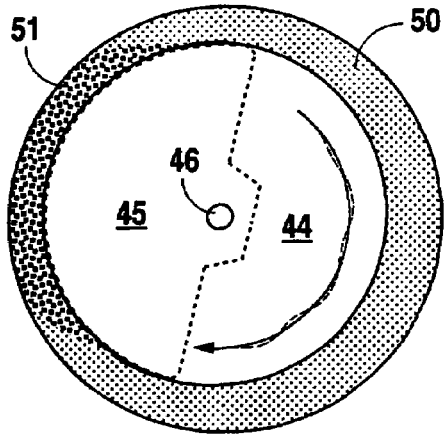
Figure 11C:
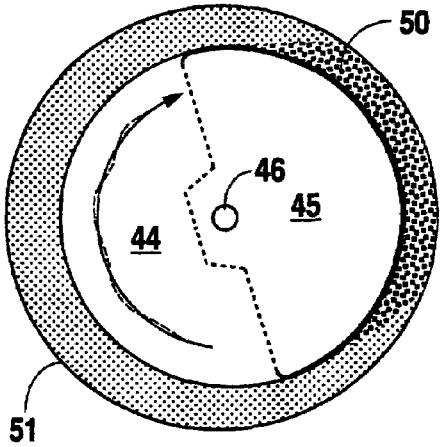
Figure 11D:
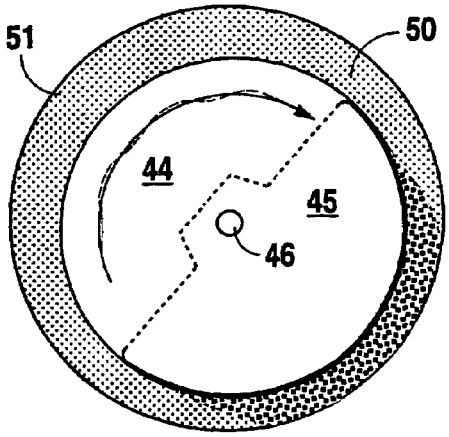
Figure 11E:
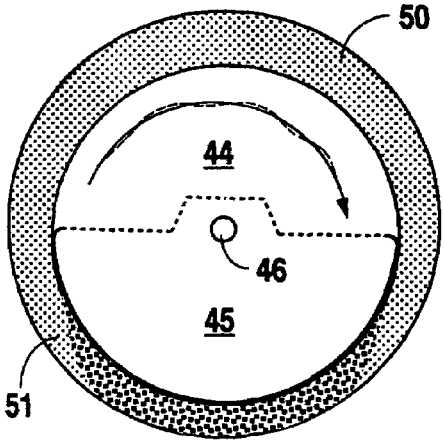
Figure 11F:
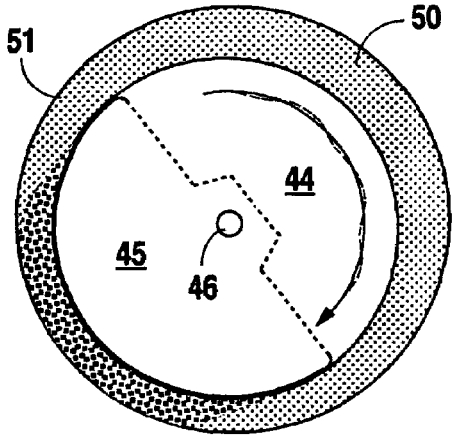

Referring now to FIGS. 9 through 11 in particular, the enhanced operation of the vibrating transducer 36 is detailed. At the outset, however, it is noted that in order to obtain maximum vibratory effect, the rigid housing 37 is provided in a generally cylindrical shape, as will be better understood further herein. In any case, as shown in the cross sectional view of FIG. 9, and corresponding views of FIGS. 11A through 11F, the forward portion 44 of the electric motor 40 is encompassed by the forward portion 51 of the foam cushion 50. At rest, i.e. without the electric motor 40 in operation, the electric motor 40 is substantially uniformly surrounded by the foam cushion 50, as shown in FIG. 11A.

Upon actuation of the electric motor 40, however, the centrifugal forces F generated by the outward throw of the eccentric weight 45 causes the axis of rotation 48 of the motor's shaft 46 to follow a conical pattern, as depicted in FIG. 10. As a result, the forward portion 44 of the electric motor 40 is thrown into the forward portion 51 of the foam cushion 50, depressing the area of cushion 50 adjacent the eccentric weight 45 and allowing expansion of the portion of the cushion 50 generally opposite, as depicted in FIGS. 11B through 11F corresponding to various rotational positions of the eccentric weight 45.

As is evident through reference to FIGS. 11B through 11F, the cooperative arrangement of the cushion 50 about the electric motor 40, as also enhanced by the cylindrical shape of the rigid housing 37, allows the eccentric weight 45 to build greater momentum than possible in embodiments where the motor is rigidly affixed to a body. As the forward portion 51 of the foam cushion 50 compresses under the centrifugal forces F of the eccentric weight 45, however, a point is reached where the foam cushion 50 is no longer compressible against the interior wall of the rigid housing 37 and the forward portion 44 of the electric motor 40 is repelled away from the interior wall toward the opposite portion of interior wall.

The result is a vibratory effect much more pronounced than that obtained in prior art configurations calling for the rigid affixation of an electric motor to a housing. Additionally, Applicant has found that the resulting pronounced vibratory effect is generally more perceptible to the human sense of touch than is that produced by prior art configurations. In particular, small differences on the order of tens of milliseconds or less in duration of operation of the vibrating transducer 36, i.e. duration of powering of the electric motor 40, are easily perceived and differentiated. As a result, this implementation of the vibrating transducer 36 is particularly adapted for implementation of the metronome of the present invention, which preferably comprises provision for distinct tactile stimuli representing downbeats versus divisional beats as well as the generation and communication of complex rhythms, which may require very quickly perceived stimulations with very little pause therebetween.

For use of the metronome of the present invention, a musician affixes the transducer 35 of a transducer unit 29 in a minimally obtrusive location utilizing a strap or the like. The musician then connects the electrical cable 42 between the transducer 35 and the receiver 31 by inserting the standard plug 43 into the output jack of the transducer unit 29. The output power level selector 55, which is preferably provided as previously described, is then utilized to adjust the "feel" of the metronome of the present invention.

With the transducers 35 positioned as desired for each musician making use of the metronome of the present invention, a conductor, bandleader, music instructor, lead musician or the like utilizes the provided control input 22 and display to set the beats per minute and, if desired, rhythmic pattern, to be generated by the signal generator 23. To this end, those of ordinary skill in the art will recognized that the display should be adapted to provide a digital readout of the current setting. Additionally, however, it is contemplated by the present invention that the display may also be adapted to provide a graphical readout comprising a musical score, such as those shown in the upper portions of FIGS. 12 and 13, especially when the controller 21 is programmed to produce more complicated rhythms such as that depicted in FIG. 13. In any case, with the transducer 35 or transducers in proper position and the base unit 20 set up as desired, the transmitter 26 and receiver 31 or receivers are powered on and the musician or musicians may perform his, her or their musical instrument or instruments of choice with the metronome under the centralized control of the conductor, bandleader, music instructor, lead musician or the like.

As will be appreciated by those of ordinary skill in the art, especially in light of this exemplary description, the controller 21 may be readily provided with a timing circuit or programmed to provide complex beat patterns. In such an embodiment, a communication interface or other programming input as well as read only or non-volatile random access memory are preferably provided for the base unit 20 such that the conductor, bandleader, music instructor, lead musician or the like may input and/or select a desired beat pattern. In one such embodiment, as will be discussed in further detail herein, an electronic score may be programmed into the controller 21, either directly or through a computer or PDA interface, whereafter the conductor, bandleader, music instructor, lead musician or the like need only select desired tempo and starting point to have the metronome of the present invention produce, for each musician provided with a transducer unit 29, rhythmic stimulation for literally a complete musical selection.

Figure 12:
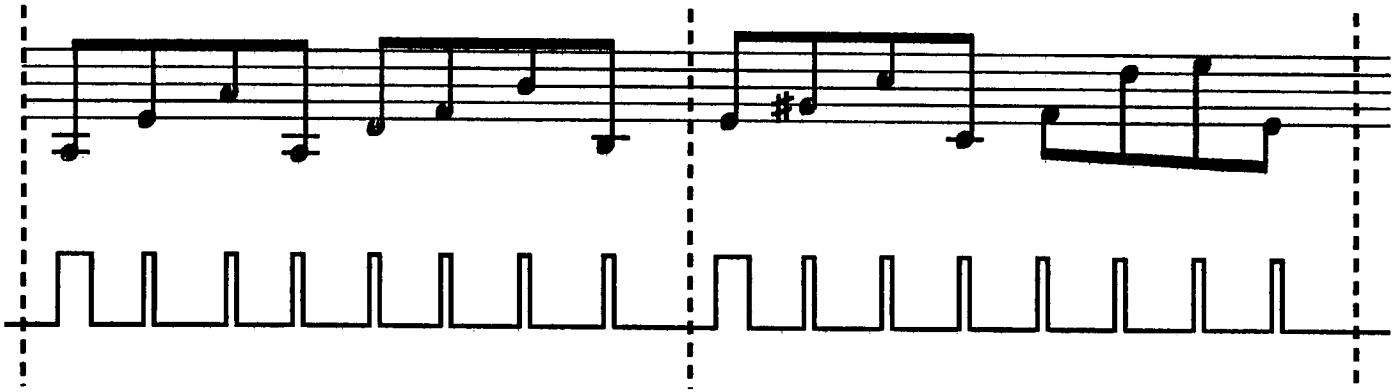
FIG. 12 shows, in a voltage waveform aligned with a musical score, a representative signal as may be generated by the signal generator of FIG. 1 for operation through the driver circuit of FIG. 6 of the vibrating transducer of FIG. 7, the waveform having characteristics such that the tempo and timing of measures of the score of FIG. 12 may be readily perceived by a musician employing the metronome of the present invention.
Figure 13:
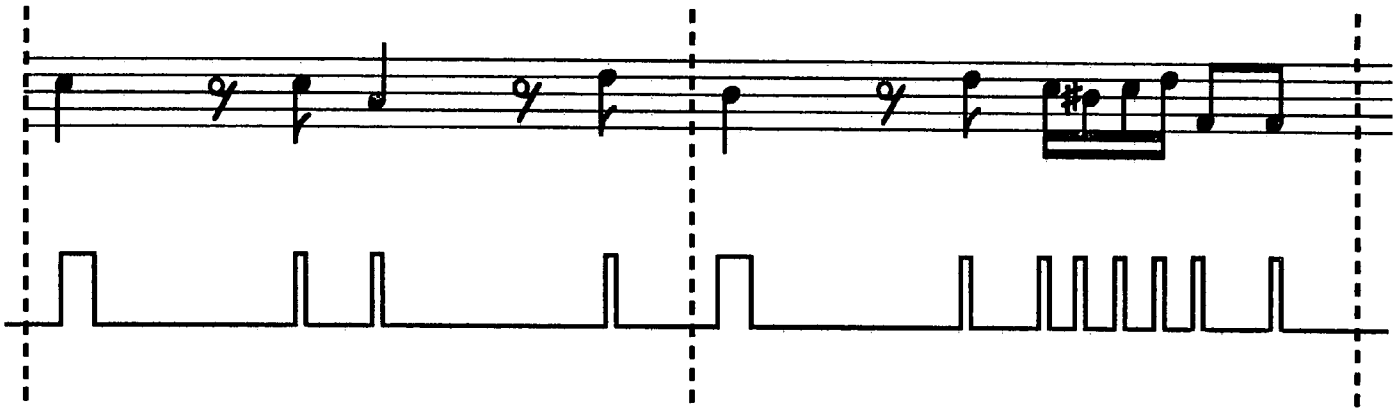
FIG. 13 shows, in a voltage waveform aligned with a musical score, a representative signal as may be generated by the signal generator of FIG. 1 for operation through the driver circuit of FIG. 6 of the vibrating transducer of FIG. 7, the waveform having characteristics such that the tempo and timing of measures, as well as the rhythm, of the score of FIG. 13 may be readily perceived by a musician employing the metronome of the present invention.

In any case, as previously discussed, the metronome of the present invention is preferably adapted to impart to a musician, or plurality of musicians, tactile stimulations indicative of tempo and measure timing, as shown in FIG. 12, as well as of tempo, measure timing and complex rhythmic patterns, as shown in FIG. 13. In particular, the preferred embodiment of the present invention contemplates imparting tempo information by the timing of the beginning of signal outputs from the signal generator 23 of the base unit 20. In order to differentiate downbeats, indicative of measure timing, the signal generator 23 is adapted under the control of the controller 21 of the base unit 20 to produce a signal output of longer duration than those indicative of divisional beats, the former of which will be noticeably perceived by the musician or plurality of musicians as being of much greater intensity than the latter, especially when imparted through the foregoing described vibrating transducer 36. As shown in FIG. 12, the controller 21 is programmed to implement these aspects of the present invention by simply effecting at a set tempo a repeating pattern of output pulses from the signal generator 23 representing the downbeats and divisional beats.

As shown in FIG. 13, however, the metronome of the present invention is also preferably adapted to impart to a musician, or plurality of musicians, tactile stimulations indicative of not only tempo and measure timing, but also complex rhythmic patterns. In this case, the controller 21 of the base unit 20 is preferably programmed to "follow" the score of a musical selection chosen by the conductor, bandleader, music instructor, lead musician or the like. In the alternative, however, the controller 21 may be pre-programmed with a plurality of rhythmic patterns, which may be simply selected through user input to the controller 21. As will be appreciated by those of ordinary skill in the art, the latter will have great utility in mastering basic rhythms. In any case, the preferred embodiment of the present invention contemplates that an appropriate programming interface be provided to allow the conductor, bandleader, music instructor, lead musician or the like to input to the controller 21 any desired rhythmic pattern or, for that matter, an entire musical score. As shown in FIG. 13, the controller 21 controls the signal generator 23 of the base unit 20 to produce output pulses only when the score calls for a note to be performed, giving greater duration, or intensity, to those pulses corresponding to downbeats.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. For example, those of ordinary skill in the art will recognize that with sacrifice of the benefits described herein with respect to the preferred embodiment of the tactile vibrating transducer 36, the transducer 35 (or transducers) of the wireless metronome of the present invention may be implemented as a piezoelectric device, buzzer, pair of electrodes, a bone density resonator, an electrical stimulation device, a mechanical transducer, an eccentric motion generator, an audible device or any other substantially equivalent structure capable of imparting the desired tactile stimulation. In any case, because the scope of the present invention is much broader than any particular embodiment, the foregoing detailed description should not be construed as a limitation of the scope of the present invention, which is limited only by the claims appended hereto.

What is claimed is:

1. A tactile metronome for use by a musician comprising:

a signal generator that generates signals according to a desired timing scheme that includes a complex beat pattern;

a short range wireless transmitter associated with the signal generator for wirelessly transmitting the signals generated by the signal generator to at least one receiving unit;

a wireless receiver associated with the at least one receiving unit for receiving the wireless signals transmitted by the short range wireless transmitter;

a tactile transducer, worn by the musician, associated with the at least one receiving unit, the tactile transducer imparting tactile stimulations to a musician in accordance with the complex beat pattern of the desired timing scheme wherein said tactile transducer includes;

a rigid housing;

an electric motor enclosed within said rigid housing, said electric motor having attached thereto an eccentric weight; and wherein said electric motor is supported within said rigid housing by a motor mount that enables the electric motor, when energized, to wobble within the rigid housing so that the eccentric weight orbits about an elliptical path.

2. The tactile metronome of claim 1, wherein the signal generator is communicatively coupled to and remain independently operable of a digital input device that enables a musician to define or select a rhythm for use in practicing or performing music.

3. The tactile metronome as recited in claim 1, said tactile metronome further comprising a strap, said strap securing said tactile transducer in place on the musician's body.

4. The tactile metronome as recited in claim 3, wherein said strap comprises hook and loop fasteners for securing one edge of said strap to another.

5. The tactile metronome as recited in claim 1, wherein said complex beat pattern is user selectable.

6. The tactile metronome as recited in claim 1, wherein said complex beat pattern is user definable.

7. The tactile metronome as recited in claim 1, said tactile metronome further comprising a programming interface to said controller, said programming interface being enabling the user to input a rhythmic pattern to said controller.

8. The tactile metronome as recited in claim 7, wherein said rhythmic pattern comprises a musical score.

9. The tactile metronome as recited in claim 1, wherein said rigid housing comprises a generally cylindrically shaped tube.

10. The tactile metronome as recited in claim 1, wherein said signal generator is programmable by interface with a computer.

11. The tactile metronome as recited in claim 10, wherein said computer comprises a personal computer.

12. The metronome as recited in claim 1, wherein said signal generator comprises a PDA.

13. The tactile metronome as recited in claim 1, wherein said tactile transducer is adapted to impart a tactile stimulation indicative of a sub-beat.

14. A metronome for use by musicians comprising:

a digital input device, including a digital display and a user interface, operable to enable a musician to define or select a complex rhythm, including a tempo and varying note values, for use in practicing or performing music;

a signal generator communicatively coupled to the digital input device, the signal generator generating signals in response to the defined or selected complex rhythm;

a tactile transducer wirelessly coupled to the signal generator and imparting multiple differentiable discrete, pulse-like tactile stimulations to a musician corresponding to varying note values of the complex rhythm defined or selected by the musician wherein said tactile transducer includes;

a rigid housing;

an electric motor enclosed within said rigid housing, said electric motor having attached thereto an eccentric weight; and wherein said electric motor is supported within said rigid housing by a motor mount that enables the electric motor, when energized, to wobble within the rigid housing so that the eccentric weight orbits about an elliptical path.

15. The metronome of claim 14, wherein the user interface enables the musician to independently define both the tempo and the note values of the complex rhythm.

16. The metronome of claim 14, further comprising:

a power supply for supplying power to the tactile transducer;

a first portable housing containing the power supply;

a second portable housing containing the tactile transducer, the second portable housing being independent of and separate from the first portable housing; and wires connecting the power supply to the transducer.

* * * * *